US008010012B2

(12) United States Patent
Idehara et al.

(10) Patent No.: US 8,010,012 B2
(45) Date of Patent: Aug. 30, 2011

(54) IMAGE FORMING APPARATUS INCLUDING A LATENT IMAGE CARRIER AND AN EXPOSING UNIT

(75) Inventors: Ryoh Idehara, Hyogo (JP); Nobuhiko Kita, Osaka (JP); Kazuyoshi Kondo, Osaka (JP); Yuusuke Furuichi, Osaka (JP); Genta Hagiwara, Ibaraki (JP); Kaoru Tada, Ibaraki (JP); Sei Onuma, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 435 days.

(21) Appl. No.: 12/230,693

(22) Filed: Sep. 3, 2008

(65) Prior Publication Data

US 2009/0074446 A1 Mar. 19, 2009

(30) Foreign Application Priority Data

Sep. 14, 2007 (JP) ..... 2007-240253

(51) Int. Cl.
*G03G 21/18* (2006.01)

(52) U.S. Cl. ..... 399/110

(58) Field of Classification Search ..... 399/110, 399/109

See application file for complete search history.

(56) References Cited

U.S. PATENT DOCUMENTS 6,545,693 B2 * 4/2003 Kitayama et al. ..... 347/138
6,785,502 B2 8/2004 Kondoh
2007/0110473 A1 5/2007 Kondo et al.
2007/0110475 A1 5/2007 Idehara et al.
2007/0166073 A1 7/2007 Idehara et al.
2007/0246638 A1 10/2007 Idehara et al.
2008/0007935 A1 1/2008 Kondo et al.
2008/0050146 A1 2/2008 Kita et al.
2008/0063425 A1 3/2008 Idehara et al.
2008/0075502 A1 3/2008 Tada et al.
2009/0297208 A1 * 12/2009 Suzuki et al. ..... 399/109

FOREIGN PATENT DOCUMENTS

JP 07181764 A * 7/1995
JP 2001-100494 4/2001
JP 2004-045923 2/2004
JP 2005-031584 2/2005
JP 2007-192894 8/2007

OTHER PUBLICATIONS

Computer Translations: JP2007-192894A, Aug. 2, 2007; JP07-181764A, Jul. 21, 1995.*

* cited by examiner

*Primary Examiner* — Quana M Grainger
(74) *Attorney, Agent, or Firm* — Harness, Dickey & Pierce, P.L.C.

(57) ABSTRACT

A biasing unit biases an exposing unit with respect to a main unit in at least one direction in a direction approaching the main body, so that the exposing unit makes contact with the main body in at least one portion to determine a position of the exposing unit with respect to the main body. A buffer unit relieves an impact the exposing unit receives from the main body, provided at or near the portion where the exposing unit makes contact with the main body. An attachment forming portion is provided for attaching the buffer unit in switching a functional state of the buffer unit between a buffer functional state and a buffer non-functional state.

13 Claims, 12 Drawing Sheets

IMAGE FORMING APPARATUS INCLUDING A LATENT IMAGE CARRIER AND AN EXPOSING UNIT

CROSS-REFERENCE TO RELATED APPLICATIONS

The present application claims priority to and incorporates by reference the entire contents of Japanese priority document 2007-240253 filed in Japan on Sep. 14, 2007.

BACKGROUND OF THE INVENTION

1. Field of the Invention

The present invention relates to an image forming apparatus including a latent image carrier and an exposing unit.

2. Description of the Related Art

Conventionally, in an electrophotographic image forming apparatus, a structure has been widely employed in which a latent image is written in by a latent image writing unit such as a laser exposing unit that carries out light scanning of laser light in respect of a latent image carrier such as a photosensitive element charged uniformly. In such an image forming apparatus, the latent image writing unit becomes obstructive to maintenance of the latent image carrier and peripheral devices such as a developing unit and the like arranged in the periphery of the latent image carrier depending on the layout in the apparatus, which sometimes results in worsening the maintainability thereof.

Hence, a method is suggested, in which the operability and the maintainability become excellent by separating an exposing unit from a main body of the image forming apparatus, and a technology is disclosed in which a biasing structure is used for the main body in respect of the positioning accuracy of the exposing unit, which is a problem of the separation (for example, see Japanese Patent Application No. 2006-008716 (Japanese Patent Application Laid-open No. 2007-192894)).

Japanese Patent Application No. 2006-008716 discloses (a) the structure in which an exposing unit is held by a cover frame fixed integrally with an openable/closable top cover, cylindrical shafts to be held that are projected from the exposing unit (casing) are allowed to penetrate through openings of the cover frame, respectively, and each of the shafts to be held is allowed to abut both "the bottom wall and the right side wall of the through opening" at the same time and is biased by an extendable bias coil spring, and (b) the structure in which the bottom wall and the right side wall of the through opening of the cover frame are made of a compressible buffer member, and an impact is eased by compressing and deforming the buffer member even when the shaft to be held collides vigorously against "the bottom wall and the right side wall of the through opening".

Furthermore, when the top cover is closed, the shafts to be held that are biased by the bias coil spring are provided to the side boards of the main body and come into contact with "the positioning unit" that controls the move of the shafts to be held, thereby positioning the exposing unit. That is, in a state of the top cover open, each of the shafts to be held that is biased by the bias coil spring can come into contact with "the bottom wall and the right side wall of the through opening of the cover frame"; however, when the top cover is closed, "the bottom wall and the right side wall of the through opening of the cover frame" with which the shaft to be held has contacted until then retreat farther than "the positioning unit", and therefore, the shaft to be held directly comes into contact with "the positioning unit".

When the image forming apparatus is conveyed, the top cover thereof is closed, and therefore the shafts to be held (the exposing unit) directly contact with the positioning unit (the main body) in a state in which the shafts to be held are biased by the biasing force of the bias coil spring. When vibration is generated at the time of conveyance, there is a fear that the shafts to be held (the exposing unit) and the positioning unit (the main body) directly collide against each other, the exposing unit moves owing to the impact, and displacement occurs in the exposure mechanism of the exposing unit.

Further, in respect of attachment of an exposing unit in an image forming apparatus, attachment methods are disclosed. One is that attachment members are provided at three positions in a case in which an optical unit in the exposing unit is housed, the attachment members at the two positions of the three are attached to the main body of the image forming apparatus with the use of fixing members, and the other one is freely supported at the other position (for example, see Japanese Patent Application Laid-open No. 2001-100494), another is that, in respect of support of a writing unit frame that holds an exposing unit, the writing unit frame is positioned by the use of a positioning pin, a front side board is attached to the front side, a rear side board is attached to the rear side opposite to the front side board, and the writing unit frame is fixed by fixing screws (for example, see Japanese Patent Application Laid-open No. 2004-45923), still another attachment method is that a damper is interposed to an exposing unit to prevent vibration generated in association with the reciprocating motion of a carriage for sub scanning of document (for example, see Japanese Patent Application Laid-open No. 2005-31584), and the like. In any attachment methods, suggested is no solution for the problem that displacement occurs in the exposure mechanism of each of the exposing units owing to move of the exposing unit by an unexpected impact force of vibration generated at the time of conveyance.

SUMMARY OF THE INVENTION

It is an object of the present invention to at least partially solve the problems in the conventional technology.

According to an aspect of the present invention, there is provided an image forming apparatus including a latent image carrier that includes an endlessly moving surface; an exposing unit that forms a latent image on the endlessly moving surface of the latent image carrier by exposing the endlessly moving surface with a light; a main unit that supports the latent image carrier and the exposing unit; a biasing unit that biases the exposing unit with respect to the main unit in at least one direction in a direction approaching the main body, so that the exposing unit makes contact with the main body in at least one portion to determine a position of the exposing unit with respect to the main body; a buffer unit that relieves an impact the exposing unit receives from the main body, provided at or near the portion where the exposing unit makes contact with the main body; and an attachment forming portion for attaching the buffer unit in switching a functional state of the buffer unit between a buffer functional state and a buffer non-functional state.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings.

An electrophotographic printer (hereinafter, "a printer") will be explained as an image forming apparatus to which the present invention is applied.

Figure 1:
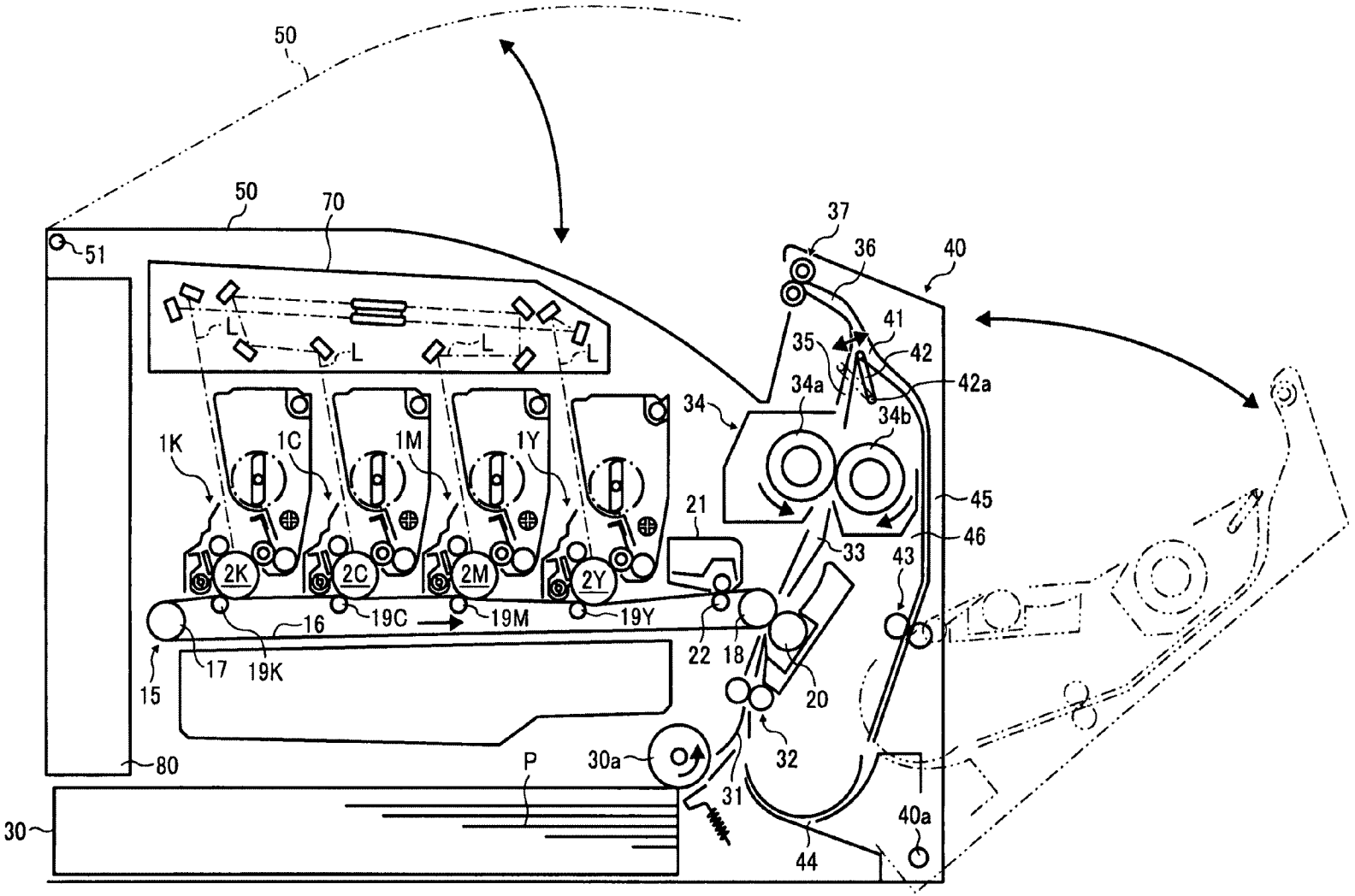
FIG. 1 is a schematic structural diagram of an image forming apparatus to which the present invention can be applied.

As shown in FIG. 1, the image forming apparatus (type A) has a structure in which an exposing unit 70 is arranged above so-called process cartridges integrated with photosensitive elements 2Y, 2M, 2C, and 2K, developing units, and the like, respectively, and detachable from an main body of the image forming apparatus. In the structure, the main body is dividable and openable into at least two structures of a top cover 50 that opens upward and a main body 80 of the apparatus that is placed below the top cover 50 and is built in with an image forming unit including the photosensitive elements 2Y, 2M, 2C, and 2K, the exposing unit 70 is held by the top cover 50 that is one divided main body (referred to as split unit) and is separated from the other divided main body 80. The type A is an image forming apparatus in which the exposing unit 70 together with the top cover 50 is separated from the main body 80.

First, the basic structure of the present printer will be explained. FIG. 1 is a schematic structural diagram of the printer. In FIG. 1, the printer is provided with four process units 1Y, 1M, 1C, and 1K that are used to form toner images of yellow, magenta, cyan, and black (hereinafter, described as Y, M, C, and K). Each process unit uses toner of Y, M, C, or K different from one another as an image forming material. Other than this, the process units have the same structure and are replaced with another new unit when their duration time is over.

Figure 2:
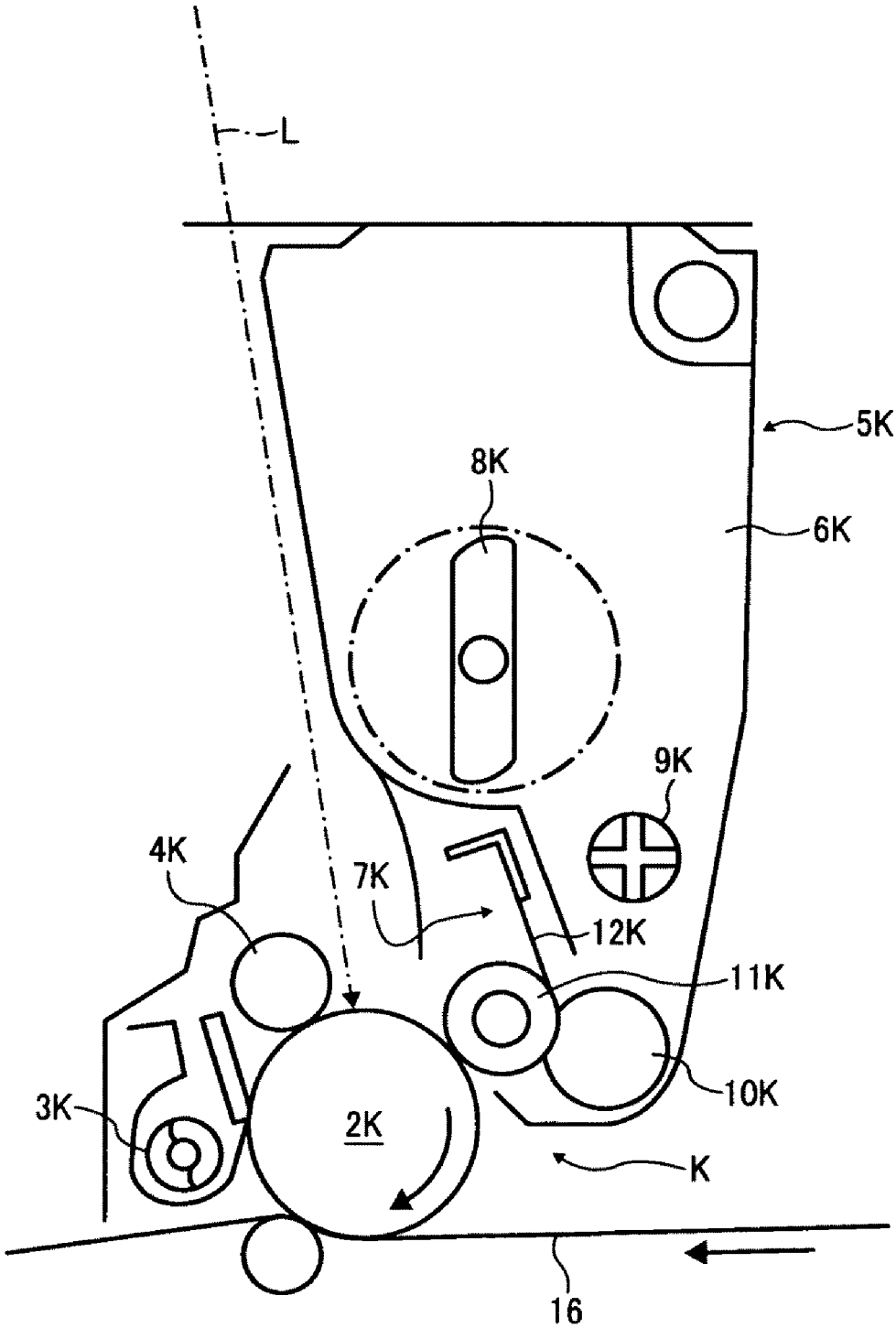
FIG. 2 is an enlarged structural diagram representing a process unit for K of the image forming apparatus.

The process unit 1K used to form a K toner image is exemplified. As shown in FIG. 2, the process unit 1K is provided with the drum-shaped photosensitive element 2K as an example of a latent image carrier that carries a latent image formed on the endlessly moving surface thereof by light emitted from the exposing unit 70 described later, a drum cleaning unit 3K, a neutralizing unit (not shown), a charging unit 4K, a developing device 5K that is a developing means, and the like. The process unit 1K that is an image forming unit is detachable from the printer main body and whose consumable parts can be exchanged at one time.

The charging unit 4K uniformly charges the surface of the photosensitive element 2K that is allowed to rotate clockwise in the illustration by a driving unit not shown. The surface of the photosensitive element 2K charged uniformly is exposure-scanned by a laser light L and carries an electrostatic latent image for K. This electrostatic latent image for K is developed into a K toner image by the developing device 5K using K toner not shown and then is intermediate transferred onto an intermediate transfer belt 16 described later.

The drum cleaning unit 3K removes the transfer residual toner adhering to the surface of the photosensitive element 2K after completion of the intermediate transfer processing. The neutralizing unit removes the residual charge of the photosensitive element 2K after the cleaning, so that the surface of the photosensitive element 2K is initialized and is ready for the next image formation. In the process units with respective other colors (1Y, 1M, and 1C), toner images (Y, M, and C) are formed on the respective photosensitive elements (2Y, 2M, and 2C) and intermediate transferred onto the intermediate transfer belt 16 described later, similarly to the photosensitive element 2K.

The developing device 5K includes a vertically-long hopper unit 6K that accommodates the K toner not shown and a developing unit 7K. In the hopper unit 6K, an agitator 8K that is rotatably driven by a driving unit not shown, an agitating paddle 9K that is rotatably driven below in the direction vertical to the agitator 8K by a driving unit not shown, a toner supply roller 10K that is rotatably driven in the direction vertical to the agitating paddle 9K by a driving unit not shown, and the like are arranged.

The K toner in the hopper unit 6K moves toward the toner supply roller 10K under its own weight while being agitated by rotational drive of the agitator 8K and the agitating paddle 9K. The toner supply roller 10K includes a metal core and a roller unit that is made of a foam resin or the like that covers the surface of the core, and rotates while allowing the K toner in the hopper unit 6K to adhere to the surface of the roller unit.

In the developing unit 7K of the developing device 5K, a developing roller 11K that rotates while contacting with the photosensitive element 2K and the toner supply roller 10K, a thin-layer blade 12K whose end contacts with the surface of the developing roller 11K, and the like are arranged.

The K toner adhering to the toner supply roller 10K in the hopper unit 6K is supplied to the surface of the developing roller 11K at the contact portion between the developing roller 11K and the toner supply roller 10K. The layer thickness of the K toner supplied on the roller surface is controlled when the toner passes the contact position between the developing roller 11K and the blade 12K in association with the rotation of the developing roller 11K.

The K toner after the layer thickness is controlled adheres to the electrostatic latent image for K on the surface of the photosensitive element 2K in the development area that is the contact portion between the developing roller 11K and the photosensitive element 2K. Owing to the adhesion, the electrostatic latent image for K is developed into a K toner image.

The process unit for K has been explained with the use of FIG. 2, and Y, M, and C toner images are formed on the surfaces of the photosensitive elements 2Y, 2M, and 2C in the process units 1Y, 1M, and 1C for Y, M, and C, respectively, through the process similar to that of the process unit 1K.

In FIG. 1, the exposing unit 70 is arranged above in the direction vertical to the process units 1Y, 1M, 1C, and 1K. The exposing unit 70 that is a latent image writing unit carries out light scanning for the photosensitive elements 2Y, 2M, 2C, and 2K in the process units 1Y, 1M, 1C, and 1K respectively, by the laser light L emitted from a laser diode based on image information. By this light scanning, electrostatic latent images for Y, M, C, and K are formed on the photosensitive elements 2Y, 2M, 2C, and 2K, respectively.

Note that the exposing unit 70 irradiates the photosensitive elements with the laser light L emitted from a light source via a plurality of optical lenses and mirrors while the light is polarized in the main scanning direction by a polygon mirror rotatably driven by a polygon motor not shown.

A transfer unit 15 that moves endlessly in the counterclockwise direction in FIG. 1 while being suspended with the endless intermediate, transfer belt 16 in a tension state is arranged below in the direction vertical to the process units 1Y, 1M, 1C, and 1K. The transfer unit 15 that serves as a transfer means is provided with a driving roller 17, a follower roller 18, four primary transfer rollers 19Y, 19M, 19C, and 19K, a secondary transfer roller 20, a belt cleaning unit 21, cleaning backup rollers 22, and the like in addition to the intermediate transfer belt 16.

The intermediate transfer belt 16 is suspended in a tension state by the driving roller 17, the follower roller 18, the cleaning backup rollers 22, and the four primary transfer rollers 19Y, 19M, 19C, and 19K that are arranged inside the loop of the intermediate transfer belt 16. The intermediate transfer belt 16 is allowed to move endlessly by the rotation force of the driving roller 17 rotatably driven by a driving unit not shown in the same counterclockwise direction in FIG. 1 as the driving roller 17 is driven.

The intermediate transfer belt 16 that moves endlessly as described above is sandwiched between the four primary transfer rollers 19Y, 19M, 19C, and 19K and the photosensitive elements 2Y, 2M, 2C, and 2K. Owing to the sandwiching, formed are primary transfer nips for Y, M, C, and K at which the right face of the intermediate transfer belt 16 contacts with the photosensitive elements 2Y, 2M, 2C, and 2K.

Primary transfer biases are applied to the respective primary transfer rollers 19Y, 19M, 19C, and 19K by a transfer bias power source not shown. This leads to formation of transfer electric fields between the respective electrostatic latent images of the photosensitive elements 2Y, 2M, 2C, and 2K and the respective primary transfer rollers 19Y, 19M, 19C, and 19K. A transfer charger, a transfer brush, or the like may be employed in place of the primary transfer rollers 19Y, 19M, 19C, and 19K.

When a Y toner image formed on the surface of the photosensitive element 2Y of the process unit 1Y for Y enters the primary transfer nip for Y in association with the rotation of the photosensitive element 2Y, the Y toner image is primarily transferred from on the photosensitive element 2Y onto the intermediate transfer belt 16 by the action of the transfer electric field and the nip pressure. Onto the intermediate transfer belt 16 on which the Y toner image is primarily transferred in this way, M, C, and K toner images on the photosensitive elements 2M, 2C, 2K, respectively, are sequentially superimposed on the Y toner image for primary transfer in association with the endless move of the belt when it passes the primary transfer nips for M, C, and K. Owing to this primary transfer of the superimposition, a toner image in four colors is formed on the intermediate transfer belt 16.

The secondary transfer roller 20 of the transfer unit 15 is arranged outside the loop of the intermediate transfer belt 16 and sandwiches the intermediate transfer belt 16 with the follower roller 18 arranged inside the loop. Owing to this sandwiching, formed is a secondary transfer nip at which the right face of the intermediate transfer belt 16 and the secondary transfer roller 20 contact with each other.

A secondary transfer bias is applied to the secondary transfer roller 20 by the transfer bias power source not shown. By this application, a secondary transfer electric field is formed between the secondary transfer roller 20 and the follower roller 18 connected to the ground.

Below in the direction vertical to the transfer unit 15, a paper feed cassette 30 that accommodates recording papers P in a state of bundled papers of a plurality of papers superimposed on one another is arranged so as to be slidable and detachable from the housing of the printer. The paper feed cassette 30 allows a paper feed roller 30*a* to contact with a recording paper P as a sheet medium placed on top of the bundled papers, and the recording paper P is delivered toward a paper feeding path 31 by rotating the paper feed roller 30*a* in the counterclockwise direction in FIG. 1 at a predetermined timing.

A pair of resist rollers 32 is arranged near the end of the paper feeding path 31. Right after the recording paper P delivered from the paper feed cassette 30 is sandwiched by the resist rollers 32 therebetween, the rotation of the both rollers stops. The rotation of the resist rollers 32 is again driven at the timing when the four-color toner image on the intermediate transfer belt 16 is synchronized with the sandwiched recording paper P in the secondary transfer nip, and the recording paper P is delivered toward the secondary transfer nip.

The toner images in the respective four colors on the intermediate transfer belt 16 that adhere to the recording paper P at the secondary transfer nip are secondarily transferred collectively onto the recording paper P by the effect of the secondary transfer electric field and the nip pressure, and the toner images become a full color toner image combined with white of the recording paper P. When the recording paper P on whose surface the full color toner image is formed in the way passes through the secondary transfer nip, the paper is self stripped from the secondary transfer roller 20 and the intermediate transfer belt 16. The recording paper P is delivered to a fixing unit 34 described later via a post-transfer conveying path 33.

The transfer residual toner that is not transferred to the recording paper P adheres to the intermediate transfer belt 16 after passing through the secondary transfer nip. The toner is cleaned from the surface of the belt by the belt cleaning unit 21 that contacts with the right face of the intermediate transfer belt 16.

The cleaning backup rollers 22 arranged inside the loop of the intermediate transfer belt 16 back up the cleaning of the belt performed by the belt cleaning unit 21 from the inside of the loop.

In the fixing unit 34, a fixing nip is formed by a fixing roller 34*a* that includes a heat source such as a halogen lamp or the like not shown and a pressure roller 34*b* that rotates while contacting with the fixing roller 34*a* at a predetermined pressure. The recording paper P delivered to the inside of the fixing unit 34 is sandwiched at the fixing nip such that the surface of the recording paper P carrying the unfixed toner image adheres to the fixing roller 34*a*. Next, the toner in the toner image is softened by the effect of the heating and the pressurization, and the full color image is fixed.

The recording paper P delivered from the inside of the fixing unit 34, followed by passing through a post-fixing conveying path 35 comes to a dividing point for braches to a paper delivery path 36 and a pre-reverse conveying path 41. A switching claw 42 driven pivotally about a rotary shaft 42*a* is arranged on the side of the post-fixing conveying path 35, and the vicinity of the end of the post-fixing conveying path 35 is opened and closed by the pivot of the switching claw 42.

At the timing of delivering the recording paper P from the fixing unit 34, the switching claw 42 stops at the pivot position shown by the solid lines in FIG. 1 and opens the vicinity of the end of the post-fixing conveying path 35. Accordingly, the recording paper P enters the inside of the paper delivery path 36 from the post-fixing conveying path 35 and is sandwiched between the rollers of a pair of paper delivery rollers 37.

When a one-side printing mode is set by input operation input on an operating unit includes a ten key pad and the like not shown, a control signal transmitted from a personal computer and the like not shown, the recording paper P sandwiched by the paper delivery rollers 37 is discharged to the outside of the apparatus as it is and stacked on a stacking unit that is the top surface of the top cover 50 of the housing.

On the other hand, when a duplex printing mode is set and when the rear end side of the recording paper P delivered inside the paper delivery path 36 while the front end side of the recording paper P is sandwiched by the paper delivery rollers 37 passes through the post-fixing conveying path 35, the switching claw 42 pivots to the position shown by the dotted lines in FIG. 1, whereby the vicinity of the end of the post-fixing conveying path 35 is closed. At approximately the same time, the paper delivery rollers 37 begin to rotate reversely. At this time, the rear end side of the recording paper P is delivered the other way around and first enters the inside of the pre-reverse conveying path 41.

FIG. 1 represents the present printer viewed from the front side thereof. The front face of the printer is on the front side in the direction orthogonal to the paper in the illustration and the rear face thereof is on the rear side therein. The right side face of the present printer is on the right side in the illustration and the left face thereof is on the left side therein. The right end unit of the present printer pivots about a rotary shaft 40*a*, and therefore it serves as an openable/closable reversing unit 40 in respect of the housing main body of the printer. When the paper delivery rollers 37 rotate reversely, the recording paper P enters the inside of the pre-reverse conveying path 41 of the reversing unit 40 and is delivered from the upper side to the lower side in the vertical direction. After the recording paper P passes between the rollers of a pair of reverse conveying rollers 43, the paper enters the inside of a reverse conveying path 44 that is semicircularly curved.

Further, while the top surface and the back surface of the recording paper P are turned over concurrently with the conveyance of the paper along the curved shape, the traveling direction from the upper side to the lower side in the vertical direction is also reversed, and the paper is conveyed from the lower side to the upper side in the vertical direction. After this, the recording paper P re-enters the secondary transfer nip after passing through the inside of the paper feeding path 31. After images in the respective four colors are secondarily transferred collectively onto the other surface as a full color image, the recording paper P passes successively through the post-transfer conveying path 33, the fixing unit 34, the post-fixing conveying path 35, the paper delivery path 36, and the paper delivery rollers 37 and is discharged to the outside of the apparatus.

The reversing unit 40 has an exterior cover 45 and a swinging body 46. More specifically, the exterior cover 45 of the reversing unit 40 is supported so as to pivot about the rotary shaft 40*a* provided to the housing of the printer main body. Owing to the pivot, the exterior cover 45 is opened and closed with the swinging body 46 held inside the exterior cover 45 in respect of the housing.

As shown by the dotted lines in FIG. 1, when the exterior cover 45 is opened with the swinging body 46 provided therein, the paper feeding path 31, the secondary transfer nip, the post-transfer conveying path 33, the fixing nip, the post-fixing conveying path 35, and the paper delivery path 36 that are formed between the reversing unit 40 and the printer main body side are vertically divided into two and exposed to the outside. Owing to this, a jammed paper in the paper feeding path 31, the secondary transfer nip, the post-transfer conveying path 33, the fixing nip, the post-fixing conveying path 35, or the paper delivery path 36 can be removed with ease.

The swinging body 46 is supported by the exterior cover 45 so as to pivot about an oscillation shaft not shown that is provided in the exterior cover 45 in a state of the exterior cover 45 open. Because of the pivot, when the swinging body 46 is opened in respect of the exterior cover 45, the pre-reverse conveying path 41 and the reverse conveying path 44 are vertically divided into two and exposed to the outside. Owing to this, a jammed paper inside the pre-reverse conveying path 41 or the reverse conveying path 44 can be easily removed.

The top cover 50 of the housing of the printer is supported pivotably about a shaft member 51 as shown by the arrow in FIG. 1. When the top cover 50 pivots in the counterclockwise direction in the illustration, the cover is in an open state in respect of the housing, which allows the upper opening of the housing to be extensively exposed.

Figure 3:
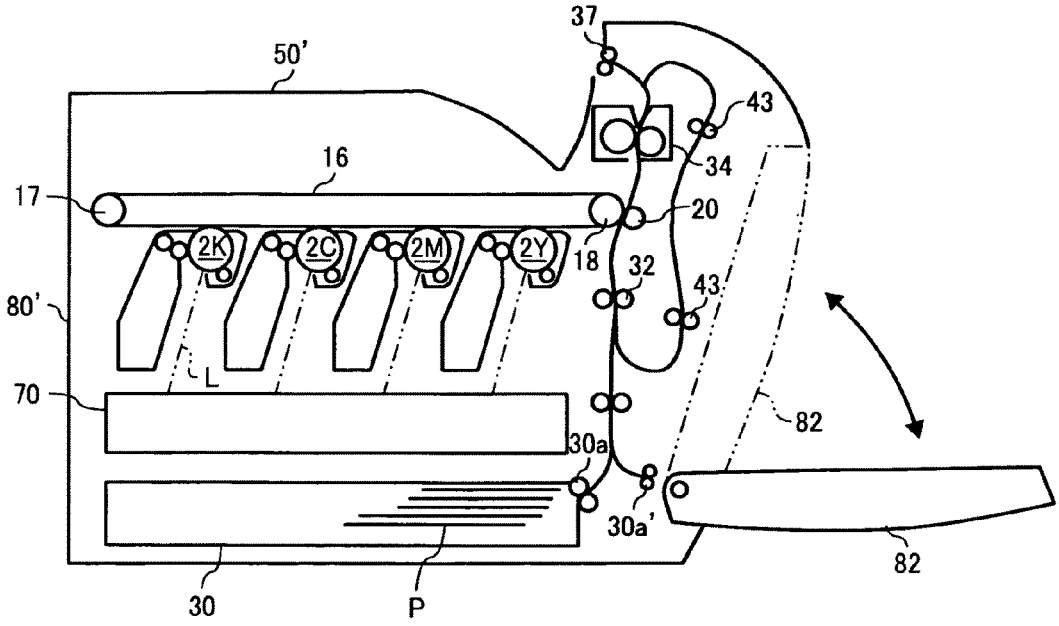
FIG. 3 is another schematic structural diagram of the image forming apparatus to which the present invention can be applied.

As shown in FIG. 3, an image forming apparatus (type B) has a structure in which the exposing unit 70 is arranged below so-called process cartridges integrated with the photosensitive elements 2Y, 2M, 2C, and 2K, the developing units, and the like, respectively, and detachable from the main body of the image forming apparatus. A top cover 50' located in the upper portion of a main body 80' of the apparatus has a function as a paper delivery tray and does not support the exposing unit 70. Inside the main body 80' built in with the image forming unit arranged below the top cover 50' and including the photosensitive elements 2Y, 2M, 2C, and 2K, the intermediate transfer belt 16, the photosensitive elements 2Y, 2M, 2C, and 2K, and the exposing unit 70 are arranged in sequence from top to bottom, and the arrangement differs from that in FIG. 1 in that the arrangement position of the exposing unit 70 changes from on the top to in the lower portion of the apparatus. Since the basic process and the steps of the image formation are similar to those explained in FIG. 1, the same reference numerals and symbols are used for the members having identical functions. An open/close cover 82 on the right side has a function as a manual paper feed tray, and papers can be manually fed with the use of paper feed rollers 30*a*' in a state of the open/close cover 82 open shown by the solid line.

Figure 4A:
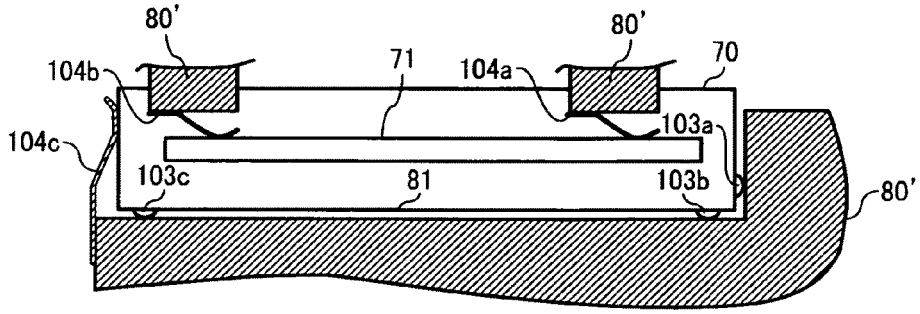
FIG. 4A is a structural diagram of an exposing unit support not provided with any buffer unit.

As to the image forming apparatus (type B) shown in FIG. 3, a bias and contact positioning structure of the exposing unit 70 is shown in FIG. 4A as a reference comparative example of the present invention.

The exposing unit 70 is placed in an attachment recessed portion 81 formed in the main body 80', projections 103*b* and 103*c* provided on the lower surface of the exposing unit 70 contact with the bottom surface of the attachment recessed portion 81, and a projection 103*a* provided on the right side portion of the exposing unit 70 contacts with the side face of the attachment recessed portion.

Biasing members 104*a* and 104*b* attached to the main body 80' as biasing units contact with a contact step 71 formed in part of the exposing unit 70 and bias the contact step 71 downward to the main body 80'. Similarly, a biasing member 104*c* attached to the main body 80' as a biasing unit contacts with the left side portion of the exposing unit 70 and biases the exposing unit 70 rightward to the main body 80'.

As shown in FIG. 4A, the exposing unit 70 is pressed to the main body 80' by the biasing force; however, the exposing unit 70 is not fixed, and therefore, the projections 103*a*, 103*b*, and 103*c* and the main body 80' directly collide against each other when receiving a vibration and an impact, whereby displacements of the positions of the lenses and the mirrors inside the exposing unit 70 occur and a possibility that a problem of an abnormal image occurs becomes high.

Figure 4B:
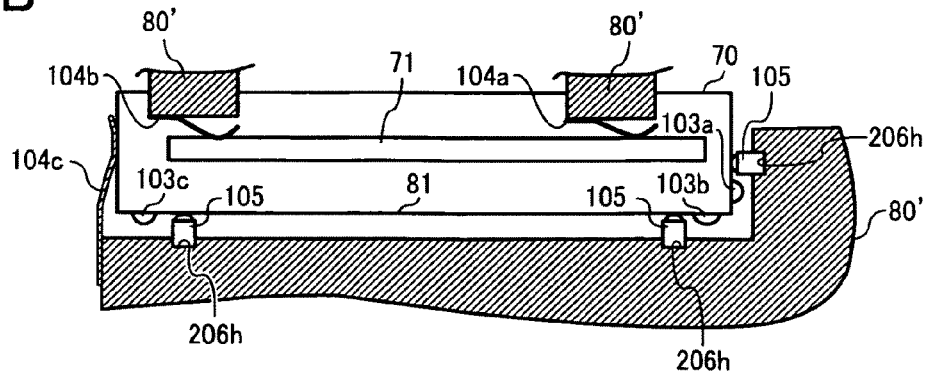
FIG. 4B represents an exemplified structure of connecting portions of buffer units.

As shown in FIG. 4B, the present invention has a structure in which a plurality of buffer units 105 that ease an impact the exposing unit 70 receives from the main body 80' due to the collision of the exposing unit 70 against the main body 801 are arranged corresponding to the biasing members 104*a*, 104*b*, and 104*c* near the contact portions between the exposing unit 70 and the main body 80', and the exposing unit 70 is not allowed to directly contact with the main body 80' by permitting the exposing unit 70 (the projections 103*a*, 103*b*, and 103*c*) to contact with the buffer members. For this, attachment holes 206*h* for the buffer members that allow the buffer units 105 to be detached are formed in advance in the attachment recessed portion 81 of the main body.

In a state where the buffer units 105 are attached to the attachment holes 206*h*, the, buffer units 105 are interposed between the exposing unit 70 and the main body 80', and the exposing unit 70 is in a buffer functional state in which an impact the exposing unit receives from the main body 80' is eased. When the buffer units 105 are detached from the attachment holes 206*h*, the exposing unit 70 and the main body 80' directly contact with each other via the projections 103*a*, 103*b*, and 103*c*, and therefore, the state becomes a buffer non-functional state. Accordingly, the respective attachment holes 206*h* constitute attachment forming portions of the buffer units that can switch a buffer functional state to a buffer non-functional state that is not a buffer functional state depending on whether the buffer units 105 are attached or detached from the attachment holes 206*h*.

In the state where the buffer units 105 in FIG. 4B are attached, the exposing unit 70 is pushed in the respective bias directions of the biasing members 104*a*, 104*b*, and 104*c* via the buffer units 105. Hence, the exposing unit 70 is allowed to be near in a fixed state by making the bias pressure high, whereby the exposing unit 70 is tolerable for the vibration and the impact at the time of conveyance.

Accordingly, while adopting the bias and contact positioning structure excellent in the positioning of the exposing unit, the image forming apparatus in which disadvantages such as displacement in the exposure mechanism constituting the exposing unit are not generated by the vibration and the impact at the time of conveyance and the like can be provided.

Although not shown, as a modification example, projection portions are formed in place of the attachment holes (the attachment forming portions) 206*h* to serve as attachment forming portions of the buffer units, and each semi-cylindrical buffer unit having a bottom is attached to the projection portion and is allowed to have the same function as that of the buffer unit 105.

As another modification example, each of the projections 103*a*, 103*b*, and 103*c* shown in FIG. 4B is made in a shaft-like shape having gradually narrowing reverse taper to serve as an attachment forming portion of the buffer unit, and the buffer unit made of an elastic material is fit with the shaft-like projection portion, thereby obtaining a buffer function.

However, in any of the examples, when the image forming apparatus is conveyed, the buffer units are individually attached in advance and detached after the conveyance, and the exposing unit 70 has to be returned to being in a positioning function state with the use of the projections 103*a*, 103*b*, and 103*c*, which leads to complex work. Particularly, in the example in which the attachment recessed portion 81 is provided in the inside of the main body 80', the work is not easy.

In the present example, provided is a means that can more easily switch buffer units from in a buffer functional state to in a buffer non-functional state than that in the first example.

Figure 5A:
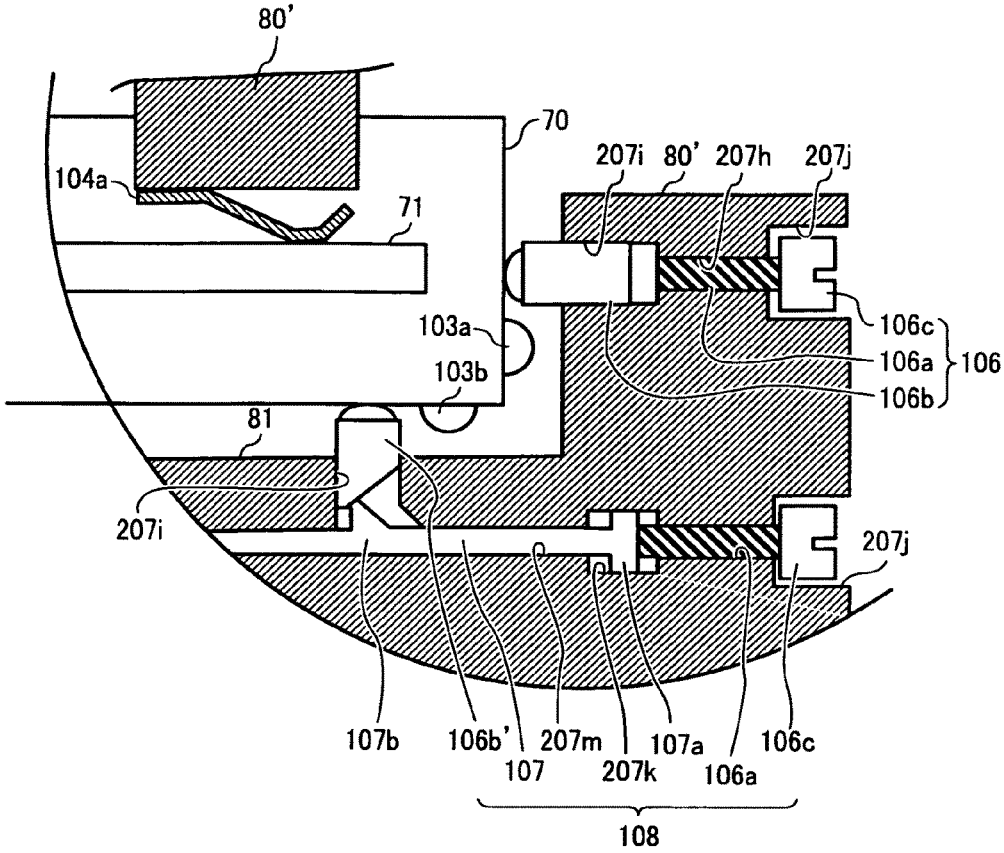
FIG. 5A is a cross sectional view in which driving mechanisms of the buffer units are explained.
Figure 5B:
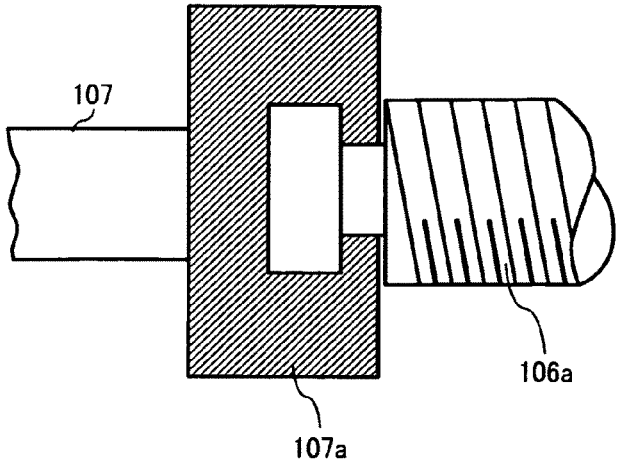
FIG. 5B is a cross sectional view of a connecting portion of a buffer member.
Figure 5C:
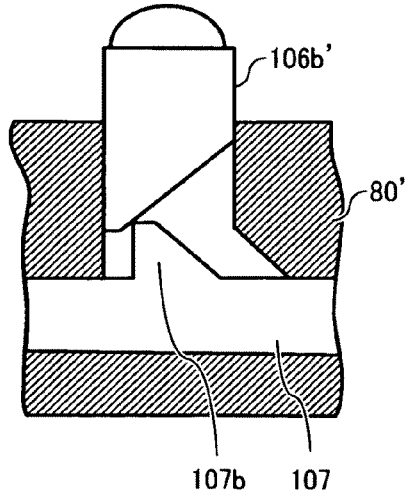
FIG. 5C is a cross sectional view in which a structure of a part that drives a contact member accompanying a buffer member is explained.

In the example shown in FIGS. 5A to 5C, an attachment forming portion for a buffer unit formed in the main body 80' includes a screw hole and a cylinder that communicates on the axis of the screw hole. As the attachment forming portion for the buffer unit, two examples of a first case and a second case will be shown.

(Case 1) This case is suitable when the exposing unit 70 is placed in the advancing direction of the screw hole. In FIG. 5A, the attachment forming portion for a buffer unit includes a screw hole 207*h* that opens on the front side of the main body 80' (see FIG. 6) via a recessed portion 207*j* that houses a screw head and a guide hole 207*i* for guiding a contact member that communicates on the axis of the screw hole 207*h* and opens on the side wall of the attachment recessed portion 81.

A screw 106*a* is screwed into the screw hole 207*h*. A cylindrical contact member 106*b* is fixed to an end of the screw 106*a*. By rotating a screw head 106*c*, the contact member 106*b* can come into contact with the side portion of the exposing unit 70 and be separated from the exposing unit 70 according to the rotation direction.

A buffer unit 106 that is interposed between the exposing unit 70 and the main body 80' and eases an impact that the exposing unit 70 receives from the main body 80' in a buffer functional state includes the screw 106*a*, the contact member 106*b*, and the screw head 106*c*.

The buffer unit 106 is attached with the use of the screw hole 207*h*, the guide hole 207*i*, and the recessed portion 207*j* that constitute the attachment forming portion, and can push the contact member 106*b* to the side portion of the exposing unit 70 against the biasing force of the biasing member 104*c*, separate the projection 103*a* from the side wall of the attachment recessed portion 81, and retreat and separate the contact member 106*b* from the exposing unit 70 so as to keep the contact state stable after the projection 103*a* comes into contact with the side wall of the attachment recessed portion 81 by the reverse action. In other words, the contact member 106*b* can be switched from in a buffer functional state to in a buffer non-functional state that is not a buffer functional state.

As a modification example, even if a structure is used in which the cross section in the direction perpendicular to the axis of the contact member 106*b* and the guide hole 207*i* fit therewith is made polygonal, the screw hole 207*h* is made a clearance hole, and the end of the screw 106*a* is screwed into the contact member 106*b*, similarly to the example, the same operation can be carried out according to the rotation direction of the screw 106*a* based on the principle of screw and nut.

(Case 2) This case is suitable when the exposing unit 70 is placed in the direction deviating from the traveling direction of the screw hole. In FIG. 5A, an attachment forming portion of a buffer unit includes the screw hole 207*h* that opens on the front side of the main body 80' (see FIG. 6) via the recessed portion 207*j* that houses a screw head, a connecting-portion housing hole 207*k* formed in one end of the screw hole 207*h*, a driving-member guide hole 207*m* formed on the extension of the screw hole 207*h* and the connecting-portion housing hole 207*k*, and the guide hole 207*i* branched in the middle of the driving-member guide hole 207*m* in the crossing direction.

The screw 106*a* is screwed in the screw hole 207*h*. A driving member 107 is fit movably in the horizontal direction inside the driving-member guide hole 207*m*, the shape of the cross section orthogonal to the moving direction of the driving member 107 is rectangle such that the driving member 107 does not rotate at the time of sliding, a connecting portion 107*a* formed in the end in the longitudinal direction of the driving member 107 is positioned in the connecting-portion housing hole 207*k* and connected to the end of the screw 106*a*. As shown in FIG. 5B, the structure of the connecting portion is a well-known structure in which the end of the screw 106*a* is rotatable and locked inside the connecting portion 107*a*. As shown in FIG. 5C, a projection 107*b* formed in the driving member 107 is positioned inside the guide hole 207*i* and contacts with an inclined plane formed in the bottom portion of the contact member 106*b'*.

By rotating the screw head 106*c*, the driving member 107 is allowed to move in the horizontal direction along the driving-member guide hole 207*m* according to the rotation direction of the screw head 106*c*. With this movement, the projection 107*b* acts on the inclined plane formed in the bottom portion of the contact member 106*b'* to move the contact member 106*b'* vertically, whereby the contact member 106*b'* is allowed to come into contact with the bottom portion of the exposing unit 70 and be separated therefrom.

In the present example, the buffer units 106 and 108 are allowed to act against the biasing forces of the biasing members (104*a* and 104*b*) and the biasing member (104*c*) in two directions by applying the first case and the second case. By adopting a mechanism in which the projection 107*b'* is allowed to contact with the inclined plane with the use of a cum mechanism and the contact member 106*b'* is permitted to act, the screw heads 106*c* that are the operating portions of the buffer units 106 and 108 are placed near each other on the same plane, thereby making it possible to enhance the operability.

Figure 6:
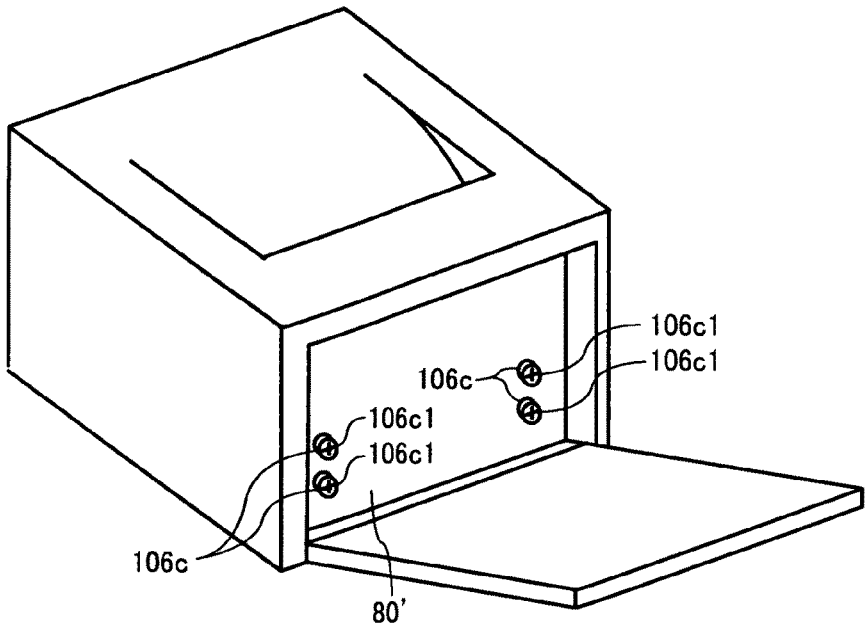
FIG. 6 is a perspective view representing a state in which part of the image forming apparatus is open.

As shown in FIG. 6, the screw heads 106*c* that are the operating portions of the buffer units 106 and 108 are provided at the positions where the screw heads are exposed to the operation opening part of the image forming apparatus, which allows a release of the exposing unit 70 from being in a pressed state by easy operation and small operation, thereby providing an excellent operability.

The buffer unit 108 that eases an impact the exposing unit 70 receives from the main body 80' is interposed between the exposing unit 70 and the main body 80' in a buffer functional state and includes the screw 106*a*, the driving member 107, and the contact member 106*b'*.

The buffer unit 108 is capable of pushing the contact member 106*b'* to the bottom portion of the exposing unit 70 against the biasing forces of the biasing members 104*a* and 104*b*, separating the projections 103*b* and 103*c* from the bottom portion of the attachment recessed portion 81, and retracting and separating the contact member 106*b'* from the exposing unit 70 so as to keep the contact state stable after the projections 103*b* and 103*c* come into contact with the bottom portion of the attachment recessed portion 81 by a reversed action. In other words, the contact member 106*b'* can be switched from in a buffer functional state to a buffer non-functional state that is not a buffer functional state.

In the image forming apparatus (type A) shown in FIG. 1, the structure of the main body 80 that holds and accommodates all various members related to image formation is dividable and openable into at least two structures of an upper main body 80*a* include the top cover 50 and its accompanying members and a lower main body 80*b* that is placed below the top cover 50 and the accompanying members, and accommodates and holds the process units 1Y, 1M, 1C, and 1K, the photosensitive elements 2Y, 2M, 2C, and 2K, the intermediate transfer belt 16, the paper feed cassette 30, the fixing unit 34, and their accompanying parts.

The exposing unit 70 is constructed so as to be held by the upper main body 80*a* (hereinafter, also referred to as "a split unit") and separated from the lower main body 80*b*, and the split unit 80*a* has an attachment forming portion of a buffer unit according to the present invention.

Hereinafter, a bias and contact positioning structure of the exposing unit will be explained.

Figure 7:
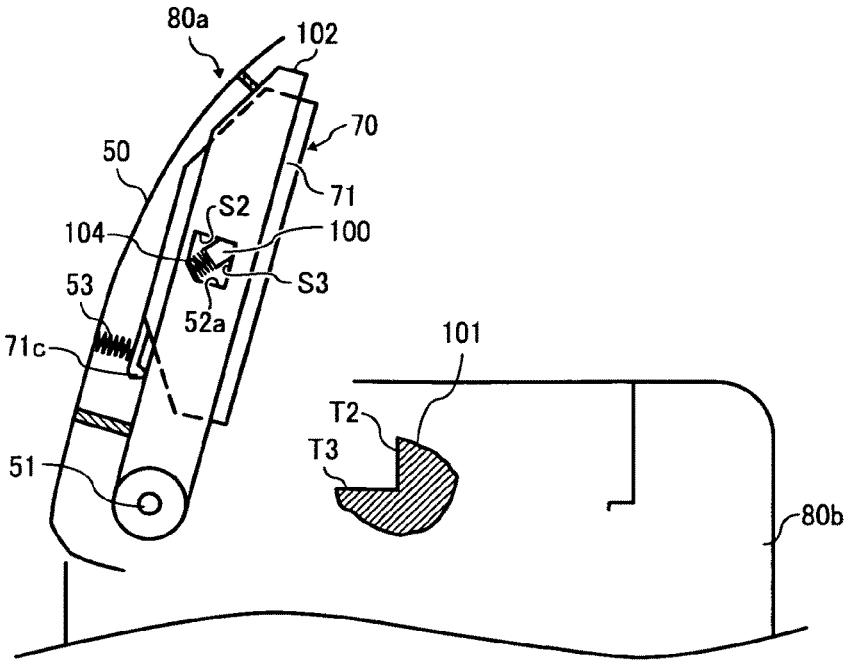
FIG. 7 is a detailed diagram to explain a structure of exposing unit holding.

FIG. 7 is an enlarged structural diagram of the top cover 50 and its peripheral structure. In FIG. 7, an exposing-unit holding member 102 that has an exposing unit holding structure is fixed to the back surface of the top cover 50, and the exposing-unit holding member 102 holds the exposing unit 70.

More specifically, the exposing-unit holding member 102 includes front and rear boards arranged opposite to each other with a predetermined space in the front-rear direction of the printer (the direction orthogonal to the paper in the illustration), and a rib not shown that connects the boards. The front board and the rear board have respective rectangular through openings arranged opposite to each other.

On the other hand, the exposing unit 70 has a cylindrical contact portion 100 projected at a positioning reference position of the front board in a casing 71 of the exposing unit 70. Therefore, the contact portion 100 is integrated with the exposing unit 70. The exposing unit 70 is placed between the front board and the rear board of the exposing-unit holding member 102. The contact portion 100 projected to the front board of the casing 71 is allowed to penetrate a through opening 52*a* provided in the front board of the exposing-unit holding member 102.

The exposing unit 70 has a hook portion 71*c* on the casing 71. The hook portion 71*c* is biased in the direction parting from the top cover 50 by an extendable spring 53 fixed to the back surface of the top cover 50 and abuts the exposing-unit holding member 102.

Although not shown in the illustration, the exposing unit 70 also has a cylindrical contact portion 100' that is projected at a positioning reference position of the rear board in the casing 71. The contact portion 100' is placed on the same axis as that of the contact portion 100, and its working function is the same as that of the contact portion 100, and therefore the explanation of the contact portion 100 is also used for that of the contact portion 100' hereinafter.

The exposing unit 70 is held by the exposing-unit holding member 102 by abutting the hook portion 71*c* arranged in the end on the left side to a top 52*b* of the exposing-unit holding member 102 while the contact portion 100 provided at the positioning reference position of the front board is allowed to penetrate the through opening 52*a* of the exposing-unit holding member 102.

The diameters of the through opening 52*a* provided in the front board and the through opening provided in the rear board not shown of the exposing-unit holding member 102 are considerably larger than that of the contact portion 100 of the exposing unit 70. In this way, the exposing unit 70 is held by the exposing-unit holding member 102 so that the exposing unit 70 freely moves in the range of the clearance between the through opening 52*a* of the front board and the contact portion 100.

The top cover 50 is openable and closable about the shaft member 51 as a fulcrum and moves by the opening and closing between a first position at which the top cover is in a completely closed state in respect of the lower main body 80*b* and a second position at which the top cover is in a completely open state in respect of the lower main body 80*b*. At this time, in association with the opening and closing of the top cover 50, the exposing unit 70 held by the exposing-unit holding member 102 moves between a retreated position (the position shown in FIG. 7) at which the exposing unit 70 does not face any one of the process units 1Y, 1M, 1C, and 1K arranged parallel to one another when the top cover is open and a writing operation position (the position shown in FIG. 8) at which the exposing unit 70 faces the respective units when the top cover 50 is closed.

In FIG. 7, one end of a biasing member 104 includes an extendable spring or the like that biases the contact portion 100 penetrating the through opening 52*a* provided in the exposing-unit holding member 102 from lower left to upper right in the slanting direction in the illustration is held by the front board of the exposing-unit holding member 102.

In FIG. 7, the contact portion 100 is placed in the center of the through opening 52*a*; however, when the top cover 50 is closed, the contact portion 100 biased by the biasing member 104 made of an extendable coil spring is allowed to abut, at the same time, both a right side wall S2 and a bottom wall S3 of the interior wall of the through opening 52*a*. Practically, as also shown in FIG. 8, the contact portion 100 is allowed to abut a right side wall T2 and a bottom wall T3 of a positioning contact portion 101 provided to the lower main body 80*b* (see FIG. 8).

To allow the contact portion 100 to abut as described above, the contact portion 100 is permitted to abut at the same time not only each one wall of the interior wall (one plane) of the through opening 52*a* and the positioning contact portion 101 but also respective two walls (two planes) of the right side wall and the bottom wall thereof. To realize the simultaneous abutting, the bias direction for the contact portion 100 by the biasing member 104 is set to the direction in which the contact portion 100 moves toward the respective two walls.

Figure 8:
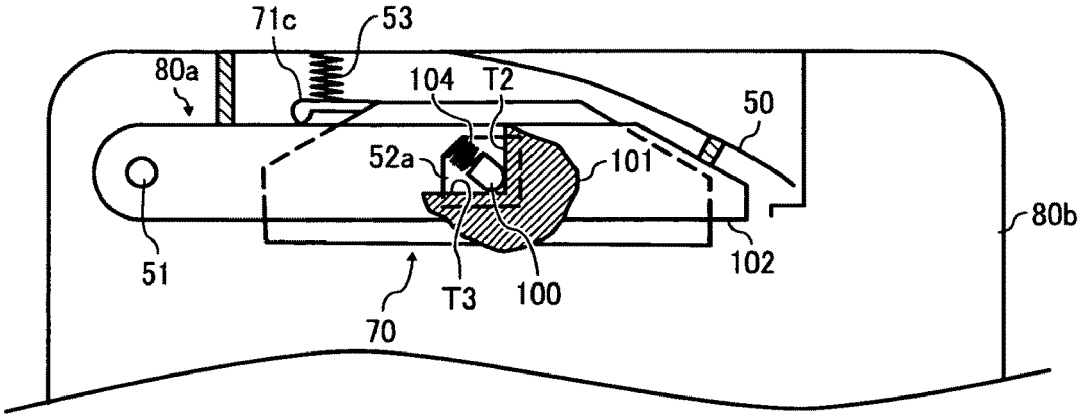
FIG. 8 is another detailed diagram to explain the structure of the exposing unit holding.

As shown in FIG. 8, when the split unit 80*a* is closed and set in the lower main body 80*b*, the contact portion 100 integrated with the exposing unit 70 contacts at the same time with the right side wall T2 and the bottom wall T3 of the positioning contact portion 101 of the lower main body, and the position of the exposing unit 70 in respect of the photosensitive elements 2Y, 2M, 2C, and 2K is determined.

Figure 9:
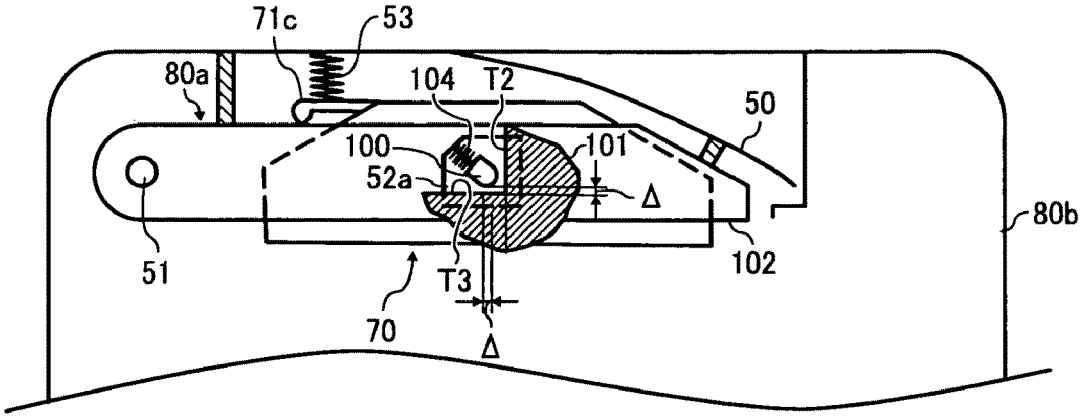
FIG. 9 is still another detailed diagram to explain the structure of the exposing unit holding.

The object of the present invention is to provide the image forming apparatus in which disadvantages such as displacement in the exposure mechanism constituting the exposing unit are not generated by the effect of collision of the exposing unit against the positioning unit of the main body due to the vibration and the impact at the time of conveyance and the like. When vibration is received at the time of, for example, conveyance, as shown in FIG. 9, the split unit 80*a* is set in the lower main body 80*b*, and moreover a clearance Δ is defined between the contact portion 100 (the exposing unit 70) and the positioning contact portion 101 (the right side wall T2 and the bottom wall T3), thereby not directly contacting with each other. Hereinafter, a means thereof is exemplified.

Figure 10:
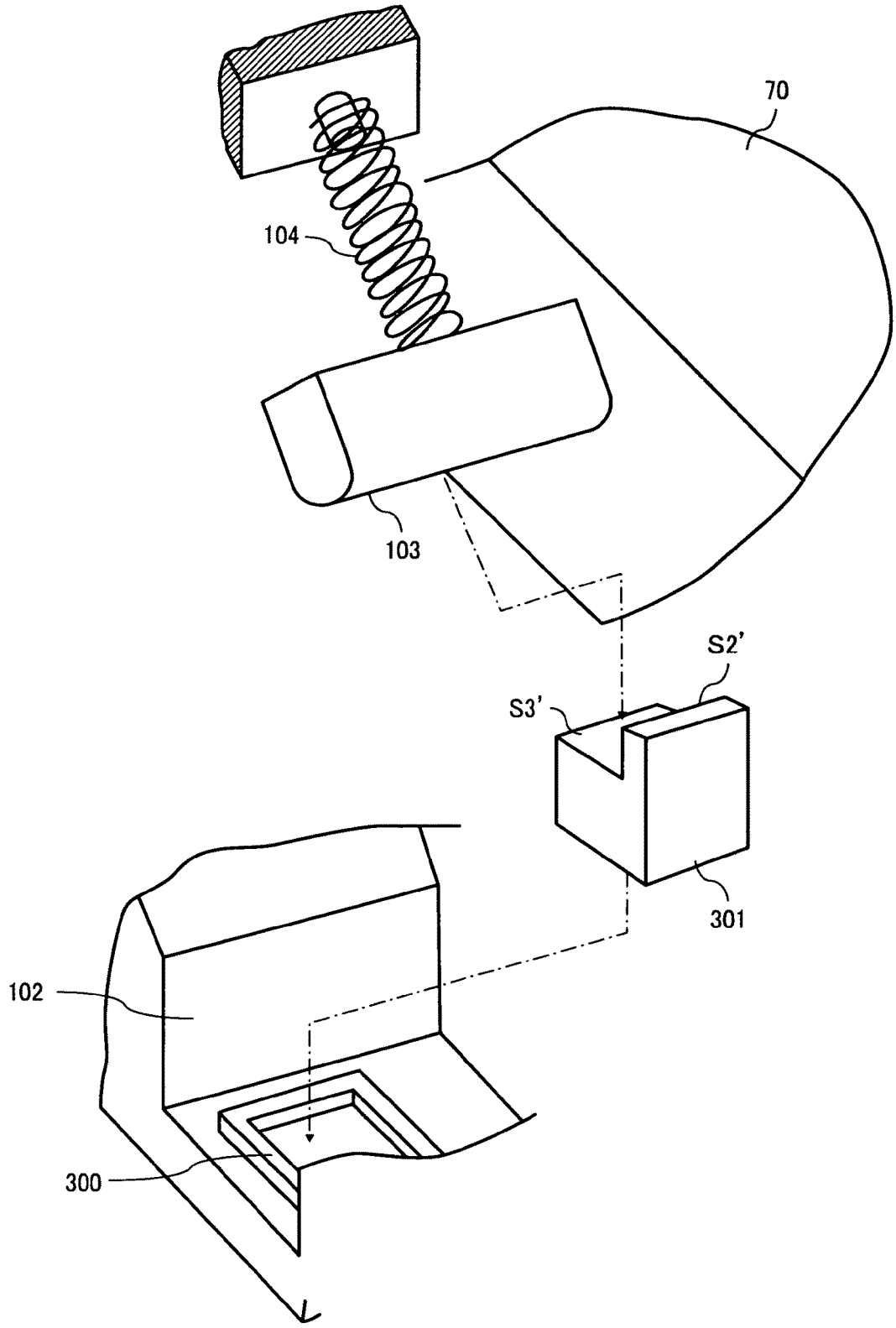
FIG. 10 is a perspective view in which an attachment direction and an arrangement of the buffer unit and the contact member are explained.

As shown in FIG. 10, an attachment forming portion 300 of a buffer member that is surrounded by a rectangular picture frame-like frame is provided to an exposing unit locking unit (the through opening 52*a*) of the exposing-unit holding member 102, and a buffer unit 301 whose outer dimension is determined the same as that of the inner frame of the attachment forming portion 300 is attached inside the inner frame of the attachment forming portion 300 by the use of concavo-convex fitting.

The side face of the buffer unit 301 is L-shaped and the buffer unit 301 constitutes, in an attached state, contact planes (a right side wall S2' and a bottom wall S3') that are as if the right side wall S2 and the bottom wall S3 were moved to the inner side in parallel (see FIG. 7). Hence, a clearance corresponding to the clearance Δ in FIG. 9 interposed between the exposing unit 70 (the contact portion 100) and the upper main body 80*a* is secured, and obtained is a buffer functional state in which an impact the exposing unit 70 receives from the main body 80 is eased. After completing conveyance and the like, the state changes to a buffer non-functional state by removing the buffer unit 301 from the attachment forming portion 300. As shown in FIG. 8, the contact portion 100 is allowed to contact with the positioning contact portion 101 (the right side wall T2 and the bottom wall T3), thereby making it possible for the exposing unit 70 to be positioned at a predetermined position.

The exposing unit locking unit (the through opening 52*a*) formed with the attachment forming portion 300 is preferred to be placed at or near the contact portion 100, and therefore the exposing unit locking unit is in a part suitable for arranging the buffer unit 301 in respect of the strength and the position of the center of gravity. In this way, in the first example, the attachment forming portion 300 and the buffer unit 301 are detachable owing to the fitting attachment structure with the use of the concavo-convex form, and the buffer unit 301 can be switched from in a buffer functional state to in a buffer non-functional state.

Figure 11:
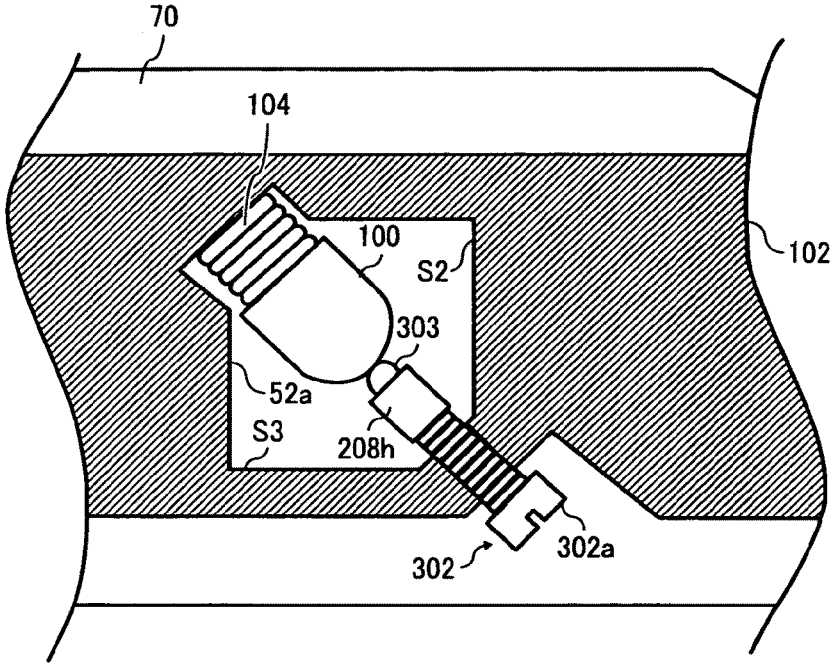
FIG. 11 is a local sectional view of a structure of exposing unit holing.

FIG. 11 is a structure using screw fitting. A screw hole 208*h* is proved to the exposing-unit holding member 102 as an attachment forming portion of a buffer unit, a screw portion of a buffer unit 302 is screwed into the screw hole 208*h*. By rotating a screw head 302*a*, the buffer unit 302 having a pressing unit 303 in the end thereof is advanced or retreated, the contact portion 100 is pushed and moved, or the buffer unit 302 is retreated from the contact portion 100, thereby making it possible to switch a buffer functional state to a buffer non-functional state.

In the present example, the structure is made advantageous in respect of looseness and displacement by the use of screw fitting, and further the structure is simple; therefore, these lead to excellent cost-saving and operability.

A fifth example will be explained with reference to FIGS. 12 and 13. In the present example, the exposing-unit holding member 102 and a buffer unit 320 are constructed integrally with each other. The buffer unit 320 has a shaft (or a hole) and is pivotably fit into a hole (or a shaft) provided to the exposing-unit holding member 102. The buffer unit 320 can move pivotally about the fitting portion as a fulcrum 305.

The buffer unit 320 is constructed as a pivotal arm, and the pressing unit 303 made of a buffer material is held in the middle of the arm. The arm is allowed to pivot about the fulcrum 305, pushes and moves the contact portion 100 with the pressing unit 303, a locking portion 306 is hooked on the corner of the exposing-unit holding member 102 at a pivoted position sufficiently apart from the right side wall S2 and the bottom wall S3, and a buffer functional state is held. The free end of the buffer unit 320 serves as a handle 307 for operation.

Figure 12:
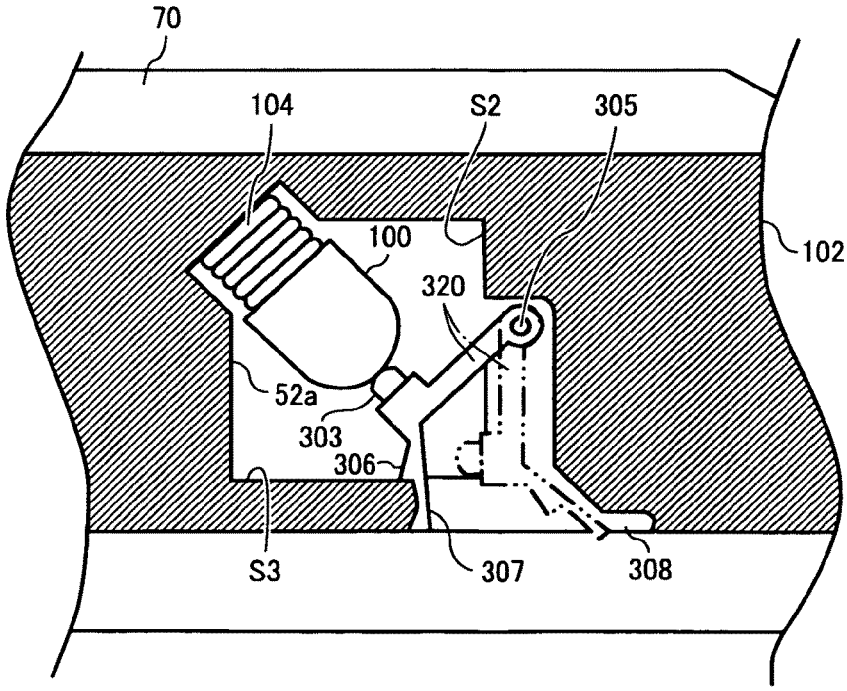
FIG. 12 is a local sectional view of a structure of another exposing unit holding.
Figure 13:
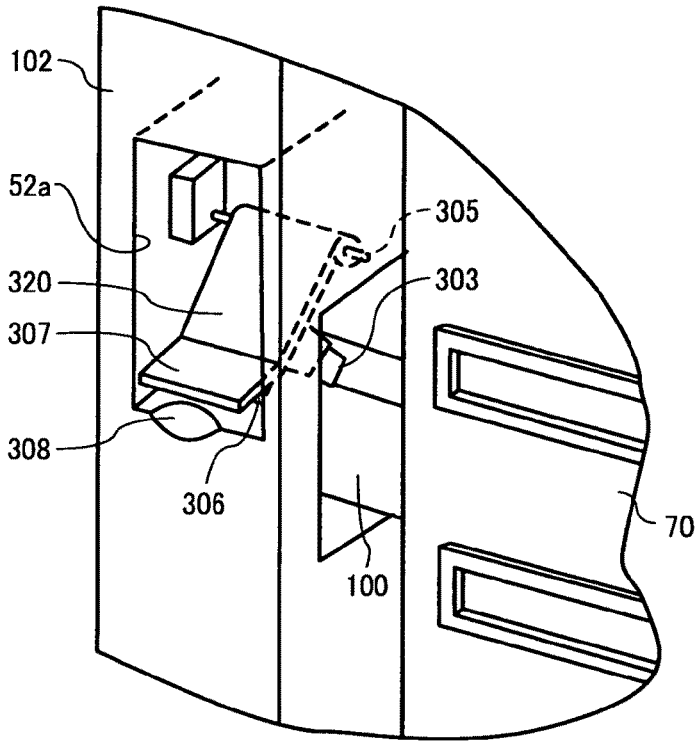
FIG. 13 is another local perspective view of the structure of the exposing unit holding.

To switch the buffer functional state shown in FIGS. 12 and 13 to a buffer non-functional state, the handle 307 is pinched to move the buffer unit 320 about the fulcrum 305 in the counterclockwise direction, thereby unlocking the locking portion 306. Then, the pressing unit 303 retreats to a recessed portion in the part farther than the right side wall S2 in association with the move of the contact portion 100 by the biasing force of the biasing member 104. In the recessed portion, formed is a recessed portion 308 for operating the handle 307 when the buffer unit 320 in the retreated state is pulled up to be in a buffer functional state.

Figure 14:
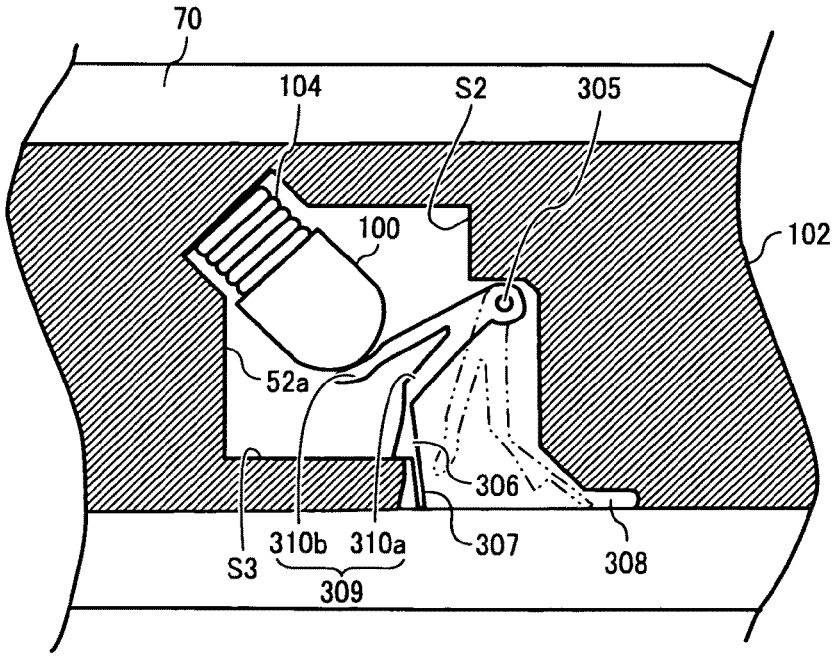
FIG. 14 is a local sectional view of a structure of another exposing unit holding.

The present example is a structural modification example of the fifth example, and its schematic appearance is similar to that of FIG. 13. The present example is characterized in that the entire buffer unit including an operating unit and a buffer functioning unit is made of only a resin. In FIG. 14, a buffer unit 309 is pivotably supported by the fulcrum 305 similarly to that of the fifth example (FIGS. 12 and 13), and a lever 310*a* having the locking portion 306 and the handle 307, and a lever 310*b* that presses the contact portion 100 are branched into two directions near the fulcrum 305.

The lever 310*b* is made of a resin material and constitutes an elastic contact portion that is elastically contactable by a resin elastic force with the contact portion 100 using the vicinity of the branched point into the levers 310*a* and 310*b* as a fulcrum. As shown in FIG. 14, the locking portion 306 presses the contact portion 100 in a locked state, resulting in a buffer functional state. When the locking portion 306 is released from the locked position, the locking portion 306 is allowed to retreat to the recessed portion in the part farther than the right side wall S2, similarly to the fifth example.

The present example is an example in which marker members 312 are provided to buffer units 311 as shown in FIGS. 15A to 15C and FIG. 16. Each of the buffer units 311 has a mounting portion 311*a* bent into a U-shape. On the other hand, the exposing-unit holding member 102 has an opening into which the contact portion 100 is inserted, and an edge portion 313 of the opening has a thickness fit with the buffer unit 311.

Figure 15A:
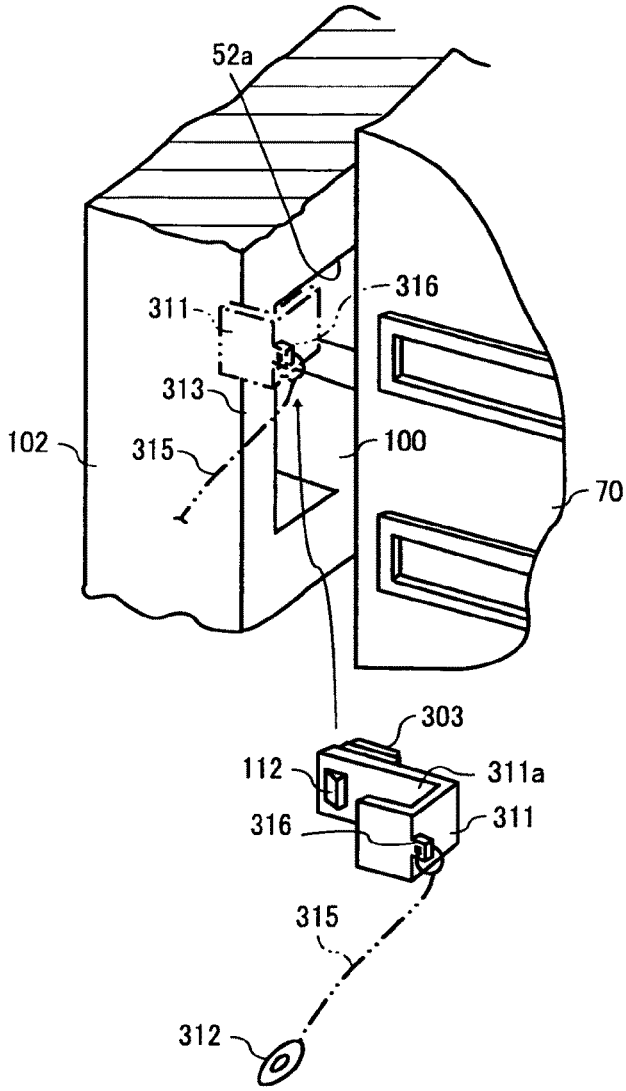
FIG. 15A is a perspective view in which an attachment direction and an arrangement of a marker of the buffer unit and the buffer unit are explained.

As shown in FIG. 15A, the mounting portion 311*a* of the buffer unit 311 is fit and engaged with the edge portion 313, a locking claw 314 formed on each of the buffer units 311 is allowed to fit to an attachment forming portion (not shown) formed of a fitting hole provided on the inner side of the edge portion 313, and the position of the buffer unit 311 is fixed by the use of a corner of the edge portion of the through opening 52*a*.

In such a mounted state, the pressing unit 303 provided to each of the buffer units 311 receives the contact portion 100 that contacts with the right side wall S2 and the bottom wall S3 by the biasing force of the biasing member 104, thereby leading to a buffer functional state. To change this state to a buffer non-functional state, the buffer units 311 are removed from the edge portion 313.

Figure 15B:
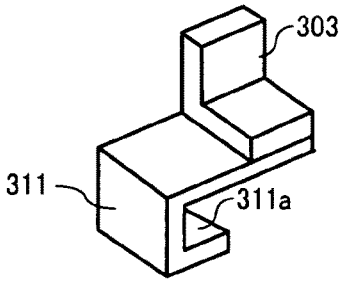
FIG. 15B is a perspective view in which a form of a pressing unit is exemplified.
Figure 15C:
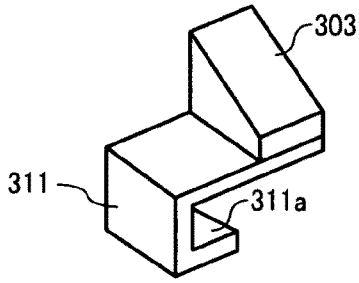
FIG. 15C is a perspective view in which another form of the pressing unit is exemplified.
Figure 16:
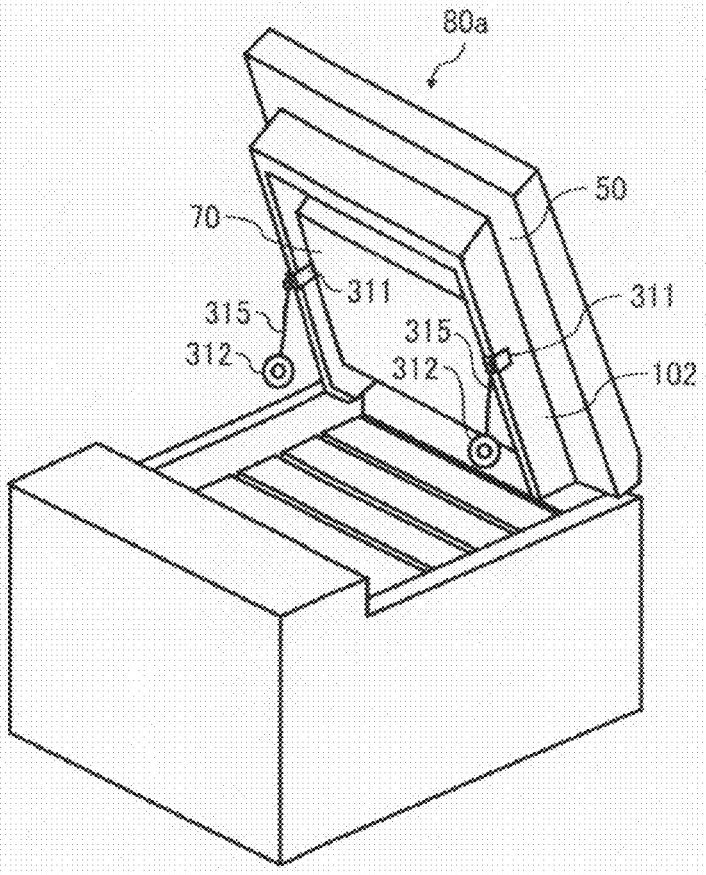
FIG. 16 is a perspective view of a state in which part of the image forming apparatus is opened.

An attachment portion 316 for string is formed on an upper portion of each of the buffer units 311 in advance, one end of a string 315 is tied to each of the attachment portions 316, and the marker member 312 is attached to the other end of the string 315. The marker members 312 are easily visible when the split unit 80*a* is opened as shown in FIG. 16, and this can urge a user to remove the buffer units 311. FIGS. 15B and 15C are exemplified forms of the pressing unit 303.

Figure 17:
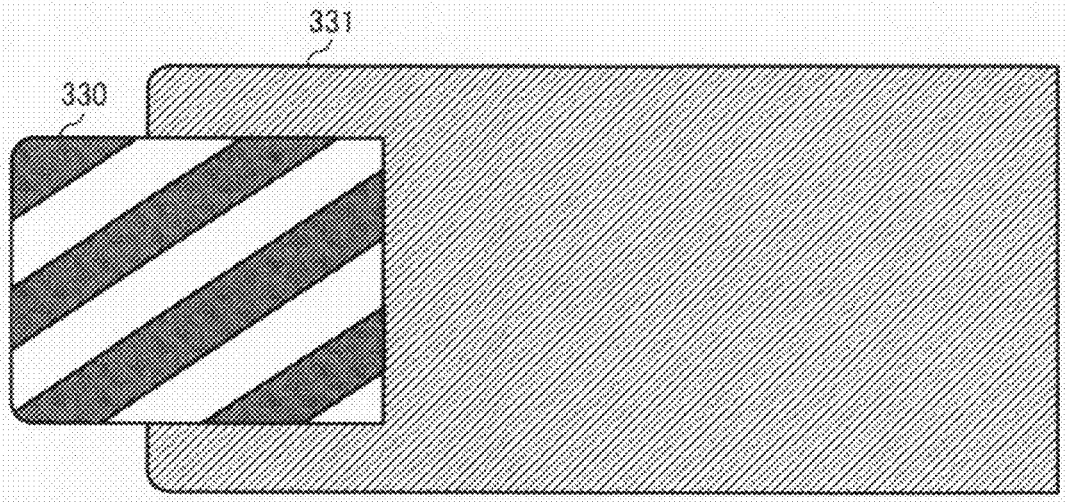
FIG. 17 is a cross sectional view in which a buffer member and a supporting unit are exemplified.

FIG. 17 represents, in each example, an exemplified structure of the part in which the buffer unit contacts with the contact portion 100 and the exposing unit 70. The contact portion is made up of a buffer member 330 and is independent of an attachment portion 331 that has no buffer function or the entire portion serves as a buffer member.

The buffer unit 105 in the first example (FIGS. 4A and 4B) includes the buffer member 330 and the attachment portion 331.

The respective contact members 106*b* and 106*b*' in the second example (FIGS. 5A to 5C) include the buffer member 330 and the attachment portion 331.

The buffer unit 301 in the third example (FIG. 10) is entirely the buffer member 330.

The buffer unit 302 in the fourth example (FIG. 11) includes the buffer member 330 and the attachment portion 331.

The pressing unit 303 of the buffer unit 320 in the fifth example (FIGS. 12 and 13) is entirely the buffer member 330.

The lever 310*b* of the buffer unit 309 in the sixth example (FIG. 14) is entirely made of a resin material and plays a role of a buffer function owing to the structural characteristics.

The pressing unit 303 provided to the buffer unit 311 in the seventh example (FIGS. 15A to 15C) may be entirely the buffer member 330 or the buffer member 330 and the attachment portion 331.

Figure 18A:
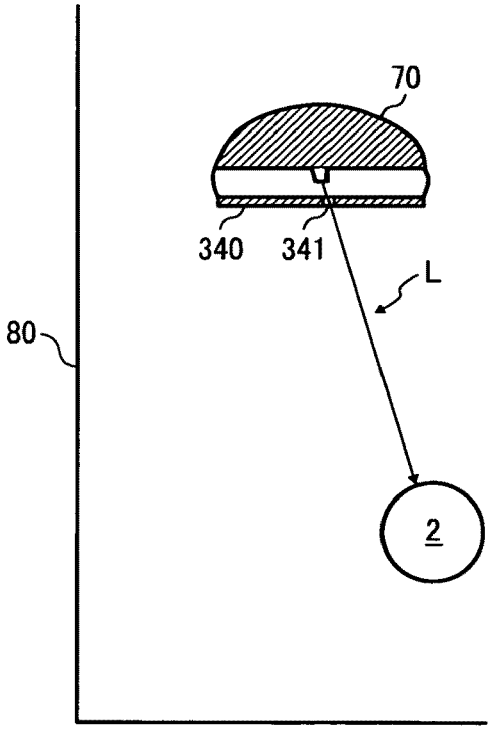
FIG. 18A is a diagram representing a state in which an exposure light normally reaches a photosensitive element in a buffer non-functional state.
Figure 18B:
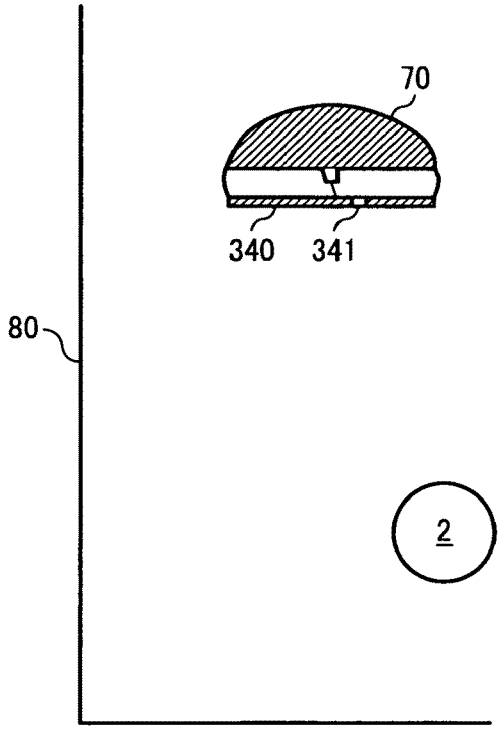
FIG. 18B is a diagram of a state in which an exposure light does not normally reach the photosensitive element in a buffer functional state.

FIGS. 18A and 18B represent a positional relation of the photosensitive element 2 and the exposing unit 70 between a state in which the buffer units press the exposing unit 70 (the contact portion 100) (a buffer non-functional state) and a non-pressed state (a buffer functional state). A shielding member 340 is provided below the exposing unit 70. As shown in FIG. 18A, a laser light passes through an opening portion 341 of the shielding member 340 and a latent image is drawn on the photosensitive element 2 in a buffer non-functional state.

When the buffer units press the exposing unit 70 (the contact portion 100) to lead to a buffer non-functional state, as shown in FIG. 18B, the position of the exposing unit 70 is displaced to upper left in the illustration, compared to that in the state in FIG. 18A. By setting a laser light not to pass through the opening portion 341 in the state, the structure in which the exposing unit 70 cannot draw a latent image on the photosensitive element 2 in the state where the buffer members press the exposing unit 70 becomes possible.

In this structure, even when a user forgets to remove the buffer units and starts to operate the image forming apparatus in a buffer functional state, the toner is not consumed because a latent image is not drawn, and an image detector not shown detects something abnormal because an image is not generated, whereby the user is urged to confirm to remove the buffer members.

In the second example (FIGS. 5A to 5C and FIG. 6) and the fourth example (FIG. 11), the buffer members can be interposed between the exposing unit and the contact portion of the main body and removed in the simple structure and by simple operation of rotating the screw, and saving space and reducing the cost are possible.

In the first example (FIG. 4B) and the second example (FIGS. 5A to 5C), the directions of the biasing forces of the biasing members 104*a*, 104*b*, and 104*c* that bias the exposing unit 70 and the contact directions of the buffer units 105 or the contact members 106*b*, and 106*b*' with the exposing unit 70 are set to approximately the same directions.

In the fourth example (FIG. 11), the screw hole 208*h* is provided to the corner portion in which the right side wall S2 and the bottom wall S3 cross each other at right angles, and the direction of the biasing force in which the biasing member 104 biases the contact portion 100 (the exposing unit 70) and the contact direction in which the buffer unit 302 contacts with the contact portion 100 (the exposing unit 70) are set approximately the same.

In the fifth example (FIG. 12), the direction of the biasing force in which the biasing member 104 biases the contact portion 100 (the exposing unit 70) and the contact direction in which a buffer unit 304 contacts with the contact portion 100 (the exposing unit 70) are set approximately the same.

Because of these, there is no loss in each pressing force, and the exposing unit can be stably fixed.

The portion of the buffer unit in each example that contacts with the exposing unit 70 and the contact portion 100 is made and constructed of a foam resin, rubber, a resin, or another absorbing material that absorbs an impact. This makes it possible to absorb vibration generated at the time of conveyance and the like and provide the image forming apparatus that saves space and reduces the cost without using a mechanism such as damper. As in the sixth example, when the buffer unit 309 is made of only a resin, reducing the necessity for disassembly of the buffer unit 309 at the time of recycling becomes possible. When the buffer unit 309 is made of the same material as that of the exposing-unit holding member, recycling thereof is possible without disassembly. Further, when a foam resin or a rubber member is used, an effect of viscoelastic vibration control can be obtained and slipping at the contact portion can be easily avoided.

In each example, when a marker unit such as a marker member is provided to the buffer unit, urging a user to allow the buffer unit in a buffer non-functional state by removing or retracting the buffer unit becomes possible after conveyance and before use of the image forming apparatus. This results in avoidance of a breakage of the goods, a loss of paper, and wasting time by the user due to misoperation.

In the seventh example (FIGS. 15A to 15C and FIG. 16), it is preferred for the operation parts of the buffer units to be provided at positions visible in an open state of the split unit 80*a*. This leads to prevention of forgetting to operate and enhancement of the easy operation itself. Reversely, when the apparatus is not preferred to be operated by a user (a service man operates), it is not desirable that the operation parts of the buffer members are provided in a part that the user can open. In this case, the operating portions are provided in a part that only the manufacturer can open, thereby avoiding occurrence of malfunction.

Reversely, when the screw heads 106*c* that are respective operating portions of the buffer units 106 and 108 are provided at respective positions where the screw heads are not exposed to the operation opening part of the image forming apparatus, it is possible to avoid erroneous operation of the buffer units by the user when handling the buffer units by the user is not preferred, and also a breakage of the goods, a loss of paper, and wasting time by the user due to misoperation can be avoided.

When attachment of the buffer units is carried out by screw fitting as shown in FIG. 6 in the second example, the respective screw heads 106*c* that are the operating portions of the buffer units 106 and 108 are formed with a groove 106*c*1 operable with a coin, which allows the exposing unit 70 in a pressed state to be released by a simple operation and a small operation, thereby making it possible to provide excellent operability. Similar operability can be provided using the screw head 302*a* shown in FIG. 11 in the fourth example.

At the time of operation and when the buffer unit is made in a form of, for example, a knob for rotation, an operating handle, or the like for the screw heads 106*c* that is directly operable without using any tool and member and with the use of part of human's body, excellent operability can be provided similarly to the above. The handle 307 shown in FIGS. 12 and 13 in the fifth example, and FIG. 14 in the sixth example can be operated by a bare hand.

According to an aspect of the present invention, it is possible to interpose the buffer members between the exposing unit and the contact portion of the main body with the use of the attachment forming portions of the buffer units while employing the bias and contact positioning structure excellent in positioning of the exposing unit, and provide the image forming apparatus in which no disadvantage such as displacement is generated in the exposure mechanism constituting the exposing unit because of vibration and impact generated at the time of conveyance.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus:

a latent image carrier that includes an endlessly moving surface;

an exposing unit that forms a latent image on the endlessly moving surface of the latent image carrier by exposing the endlessly moving surface with a light;

a main unit that supports the latent image carrier and the exposing unit;

a biasing unit that biases the exposing unit with respect to the main unit in at least one direction in a direction approaching the main unit, so that the exposing unit makes contact with the main unit in at least one portion to determine a position of the exposing unit with respect to the main unit;

a buffer unit that relieves an impact the exposing unit receives from the main unit, provided at or near the portion where the exposing unit makes contact with the main unit; and an attachment forming portion for attaching the buffer unit in switching a functional state of the buffer unit between a buffer functional state and a buffer non-functional state, wherein the attachment forming portion includes a screw hole, the buffer unit includes a screw portion and a contact portion provided at a distal end of the screw portion, and the contact portion is displaced by rotation of the screw portion screwed into the screw hole, thereby making it possible to switch the buffer unit between the buffer functional state and the buffer non-functional state.

2. The image forming apparatus according to claim 1, wherein the main unit is divided into at least two openable structures including a first division and a second division, the exposing unit is held in the first division and can be separated from the second division, the first division includes an exposing unit holding structure that biases the exposing unit, and locks the exposing unit at a locking position, and the attachment forming portion is provided at the locking position of the exposing unit holding structure.

3. The image forming apparatus according to claim 1, wherein the attachment forming portion includes either one of a shaft portion and a hole portion, the buffer unit includes a hole portion when the attachment forming portion includes the shaft portion or a shaft portion when the attachment forming portion includes the hole portion rotatably fitted with each other at a pivotable fitting portion, and the buffer unit can be switched between the buffer functional state and the buffer non-functional state depending on a stop position when the buffer unit is pivoted about the fitting portion.

4. The image forming apparatus according to claim 1, wherein a direction of biasing force by the biasing unit is substantially the same as a contact direction when the buffer unit in the buffer functional state makes contact with the exposing unit.

5. The image forming apparatus according to claim 1, wherein at least a portion of the buffer unit abutting the exposing unit is made of foam resin.

6. The image forming apparatus according to claim 1, wherein at least a portion of the buffer unit abutting the exposing unit is made of rubber.

7. The image forming apparatus according to claim 1, wherein at least a portion of the buffer unit abutting the exposing unit is in a resin elastic structure having elasticity.

8. The image forming apparatus according to claim 1, wherein the buffer unit includes a marker unit that indicates the functional state of the buffer unit.

9. The image forming apparatus according to claim 1, wherein the buffer unit includes an operating portion for switching the functional state of the buffer unit, and the operating portion is exposed to an open part of the image forming apparatus.

10. The image forming apparatus according to claim 1, wherein the buffer unit includes an operating portion for switching the functional state of the buffer unit, and the operating portion is arranged in a closed part of the image forming apparatus.

11. The image forming apparatus according to claim 1, wherein the buffer unit includes an operating portion for switching the functional state of the buffer unit, and the operating portion includes an engaging portion that is engaged with a coin such that the operating portion can be operated via the coin.

12. The image forming apparatus according to claim 1, wherein the buffer unit includes an operating portion for switching the functional state of the buffer unit, and the operating portion can be directly operated with a part of a human body.

13. The image forming apparatus according to claim 1, wherein when the buffer unit is in the buffer functional state, the light from the exposing unit does not reach the latent image carrier, and when the buffer unit is in the buffer non-functional state, the light from the exposing unit reaches the latent image carrier.

* * * * *